United States Patent [19]

Klein et al.

[11] Patent Number: 4,676,382

[45] Date of Patent: Jun. 30, 1987

[54] HANGER BARS

[75] Inventors: Frank Klein, 5500 Macdonald Ave., Apt. 803, Hampstead, Quebec, H3X 2W1; Remy Loiselle, Richelieu, both of Canada

[73] Assignee: Frank Klein, Canada

[21] Appl. No.: 882,188

[22] Filed: Jul. 7, 1986

[51] Int. Cl.[4] ..... A47H 1/02

[52] U.S. Cl. ..... 211/105.1; 211/124; 211/181

[58] Field of Search ..... 211/105.1, 105.2, 124, 211/123, 181; 52/636, 634, 693, 694; 206/289, 290, 291, 298, 284, 279

[56] References Cited

U.S. PATENT DOCUMENTS

| | | | |
|---|---|---|---|
| 1,922,989 | 8/1933 | Terry | 211/124 X |
| 2,039,497 | 5/1936 | Simons | 211/181 X |
| 3,036,676 | 5/1962 | Potzsch | 52/693 X |
| 3,610,427 | 10/1971 | Maziarka | 211/123 |
| 4,396,124 | 8/1983 | Feder | 206/290 X |

*Primary Examiner*—Ramon S. Britts
*Assistant Examiner*—Sarah A. Lechok Eley
*Attorney, Agent, or Firm*—Fishman & Dionne

[57] ABSTRACT

At least three longitudinally extending wire rods are disposed in parallel arrangement. Web means are disposed between adjacent ones of the longitudinally extending wire rods, the web means being formed of wire. In cross-section, the bar forms a continuous configuration. Longitudinally extending wire rods and the web means form between them the truss-like wire structure. A hook arrangement is disposed at each end of the truss-like wire structure for engaging a respective one of the opposed bar engagement walls.

7 Claims, 6 Drawing Figures

HANGER BARS

BACKGROUND OF THE INVENTION

1. Field of the Invention

The invention relates to a suspension bar for garment boxes. More specifically, the invention relates to such a suspension bar which comprises a truss-like wire structure. The invention also relates to means, disposed at the ends of the bar, for engaging side walls of the garment box whereby to suspend the suspension bar in a garment box.

2. Description of the Prior Art

It is known in the art to use bars for suspending garment hangers or other items, and wire-like bars for this purpose are illustrated in, for example, U.S. Pat. No. 2,120,511, Risdon, June 14, 1938, and U.S. Pat. No. 3,642,147, Voorhies, Feb. 15, 1972. However, the bars as taught in these patents are not contemplated for use in garment boxes and additionally, they do not comprise truss-like structures.

Garment boxes (also referred to as wardrobes) are taught in U.S. Pat. No. 3,057,460, Richer, Oct. 9, 1962 and U.S. Pat. No. 3,902,597, Brennan, Sept. 2, 1975. Both of these patents also teach suspension bars for use with the garment boxes. However, the suspension bar of the Richer patent is of a cardboard construction so that it is limited to the weight it can carry. The suspension bar of the wardrobe in Brennan is made of sheet steel and is therefore relatively heavy and expensive because of the quantity of steel which must be used to make it. In addition, because the edges of the sheet steel bars are rough, they could cut a user so that handling such bars could be dangerous. In addition, each size of a sheet steel bar must be made with a different die, and the cost of each die is extremely high.

SUMMARY OF THE INVENTION

It is therefore an object of the invention to provide a suspension bar for garment boxes which overcomes the above disadvantages.

It is a more specific object of the invention to provide a wire structure suspension bar for garment boxes.

It is an even more specific object of the invention to provide a truss-like wire structure suspension bar for garment boxes.

It is a further object of the invention to provide means, disposed at each end of the suspension bars, for engaging opposing walls of a garment box, whereby to suspend the suspension bar in the garment box. The engagement means also comprise wire structures.

In accordance with the invention there is provided a truss-like wire structure suspension bar for garment boxes which garment boxes have opposed bar engagement walls. The bar includes at least three longitudinally extending wire rods, the wire rods being disposed in parallel arrangement. Web means are disposed between adjacent ones of the longitudinally extending wire rods, the web means being formed of wire. In cross-section, the bar forms a continuous configuration. The longitudinally extending wire rods and the web means forming between them the truss-like wire structure. Means are disposed at each end of the truss-like wire structure for engaging a respective one of the opposed bar engagement walls.

In accordance with a preferred embodiment of the invention there is provided a truss-like wire structure suspension bar for garment boxes which garment boxes have opposed bar engagement walls. The bar includes a first top longitudinally extending wire rod and a second top longitudinally extending wire rod disposed in parallel relationship with the first longitudinally extending wire rod. A bottom longitudinally extending wire rod is disposed below and between the first and second top longitudinally extending wire rods and in parallel relationship with the plane defined by the first and second top longitudinally extending wire rods. A first web is formed between the first top longitudinally extending wire rod and the bottom longitudinally extending wire rod whereby to define a first side member and a second web is formed between the second top longitudinally extending wire rod and the bottom longitudinally extending wire rod whereby to define a second side member. A top web is formed between the first top longitudinally extending wire rod and the second top longitudinally extending wire rod whereby to define a top member. A cross-sectional view of the first side member, the second side member and the top member defines a triangular shape. The first side member, the second side member and the top member forming the truss-like wire structure. Means are disposed at each end of the truss-like wire structure for engaging a respective one of the opposed bar engagement walls.

From a different aspect, and in accordance with the invention, the engagement means comprise a hook member and a first portion for attaching the hook member to the first longitudinally extending wire rod. A second portion attaches the hook member to the second longitudinally extending wire rod and a third portion attaches the hook member to the bottom longitudinally extending wire rod.

BRIEF DESCRIPTION OF THE DRAWINGS

The invention willbe better understood by an examination of the following description, together with the accompanying drawings, in which.

DESCRIPTION OF PREFERRED EMBODIMENTS

Figure 1:
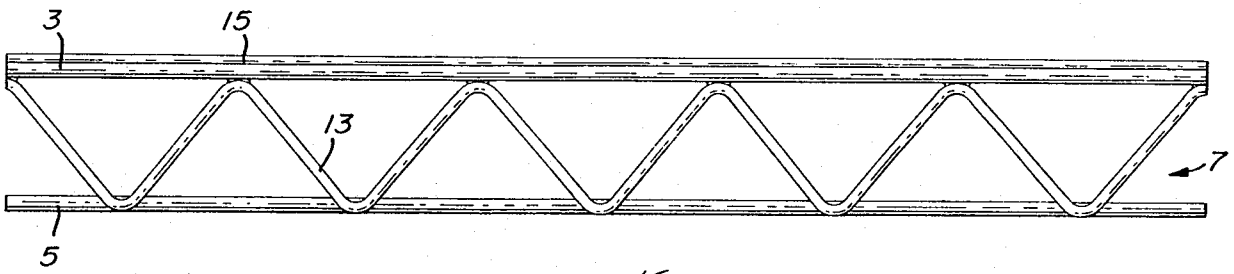
FIG. 1 is a side view of a wire structure suspension bar in accordance with the invention.

Referring to the drawings, the structure comprises a first top longitudinally extending wire rod 1 and a second top longitudinally extending wire rod 3 disposed in parallel relationship with the first top longitudinally extending wire rod 1. A bottom longitudinally extending wire rod 5 is disposed below and between the first and second top longitudinally extending wire rods 1 and 3 and is disposed in parallel relationship with the plane defined by the first and second top longitudinally extending wire rods 1 and 3.

A first side web 7 is disposed between rods 3 and 5, and a second side web is disposed between rods 1 and 5. Both the first and second side webs are preferably in the shape of repeating triangles formed of wires. As is well known, such webs are provided both for the purpose of spacing the rods between which they extend, as well as to provide structural strength for the structure. Accordingly, although a pattern of repeating triangles is preferred, this is obviously not the only pattern which can form the web as will be discussed below.

Figure 2:
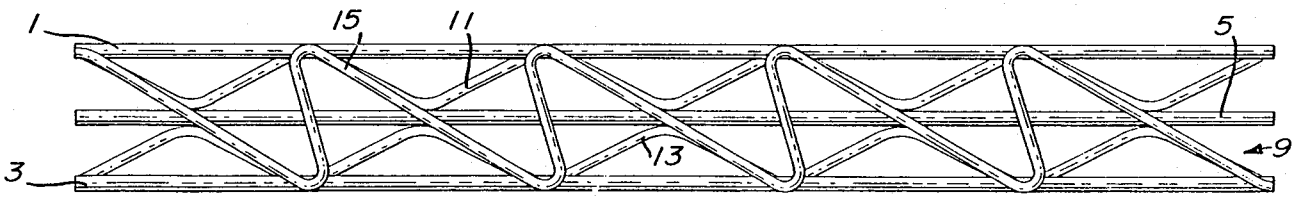
FIG. 2 is a top view of a wire structure suspension bar in accordance with the invention.

A top web 9 extends between rods 1 and 3 as shown in FIG. 2. Preferably, this web is in the shape of a saw tooth again formed of wires. The purpose of this web is also to space the rods between which they extend and to provide structural strength to the structure as a whole.

In fabricating the suspension bar, the webs are welded to the rods at all of their points of contact.

As above mentioned, the shapes of the webs could be varied to suit different needs. Thus, the shapes might be a repeating sinusoidal, or the side webs could be made in the shape illustrated herein as the top web and vice-versa.

Figure 3:
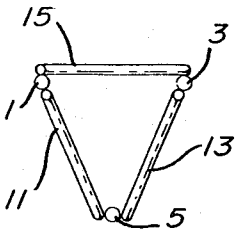
FIG. 3 is an end view of the wire structure suspension bar.

The rod and web arrangements form a first side member 11, a second side member 13 and a top member 15, and the cross sectional view of the first and second side members and the top member defines a traingular shape as shown in FIG. 3.

Figure 4:
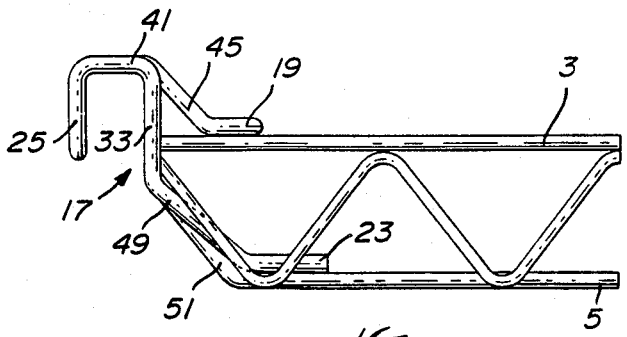
FIG. 4 is a side view of one end of the suspension bar illustrating the engagement means.
Figure 5:
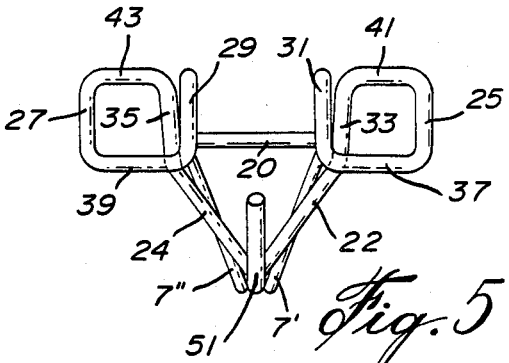
FIG. 5 is an end view of FIG. 4.
Figure 6:
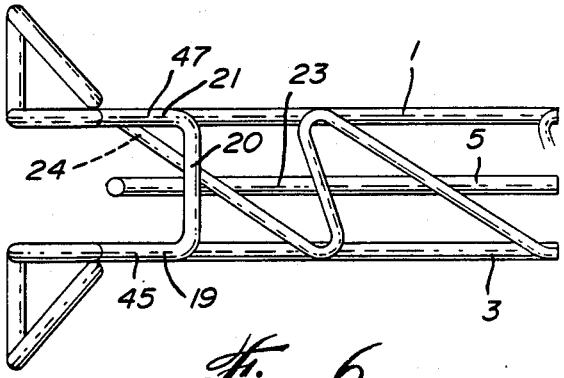
FIG. 6 is a top view of FIG. 4.

Disposed at each end of the suspension bars are means for engaging opposed bar engaging walls of the garment box, for example, the side walls in the '460 and '597 patents referenced above. A preferred embodiment of such engagement means is illustrated is FIGS. 4, 5 and 6. Only one end of the suspension bar is illustrated in FIGS. 4, 5 and 6. It will be appreciated that a similar arrangement would be disposed at the other end of the suspension bar.

Referring now to FIGS. 4, 5 and 6, the engagement means comprises a hook member 17, top rod attachment portions 19 and 21, connected by connecting portion 20, and bottom rod attachment portion 23. The hook portion comprises outer front portions 25 and 27 and inner front portions 29 and 31. The hook portions further comprise rear portions 33 and 35. Connecting portion 37 connects the front portions 25 and 31 while connecting portion 39 connects the front portions 27 and 29. The rear poritons are connected to respective ones of the front portions by connecting portions 41 and 43.

Top rod attachment portion 19 is connected to the hook portion by connecting portion 45, and top rod connecting portion 21 is connected to the hook member by connecting portion 47. Bottom rod connecting portion 23 is connected to the hook member by connecting portion 49. It will be seen from FIGS. 4, 5 and 6 that the engagement means comprises a single integral structure.

The end 51 of the rod 5 is turned upwardly so that the engagement means is caught between the end 51 and the last portions 7' and 7'' of the respective webs 7. In addition, portion 19 is welded to rod 3 at their points of contact and portion 21 is welded to rod 1 at their points of contact. Portion 23 may be left unattached resting on rod 5 or it may be welded to rod 5 at their points of contact. Thus, the attachment means are firmly connected to the suspension bar.

However, as can be seen, the engagement means are formed separately from the remainder of the suspension bar. Accordingly, the suspension bar in accordance with the invention can be made as a continuous strip and cut to size. The engagement means would then be welded to each end of the sized suspension bar. Accordingly, when orders are received, a continuous strip is manufactured and the bars are cut to size and the engagement means are fixed at both ends of the sized bars.

In addition, because the entire structure is made of wire, it does not require as much material as the steel sheet suspension bars of the prior art. It is therefore both significantly lighter in weight and substantially less costly than the prior art suspension bars.

Further, there are no rough ends in a completed structure after the engagement means have been attached. The only rough ends, at the ends of bar 5, are turned upwardly and out of the way. Accordingly, there is no danger in handling the suspension bar in accordance with the present invention.

The suspension bar in accordance with the present invention can be formed of steel wire or any other metal wire providing the required rigidity and strength.

The strength and rigidity of the bar can be varied, as is well known in the art, by varying the gauge of the wire of which it is formed and the dimensions of the structure. For example, in varying the dimensions, the angle of the web could be increased or decreased whereby to increase or decrease the spacing between the triangle apexes. Alternatively, the spacing as between the longitudinally extending wire rods could also be increased or decreased. By varying the gauge and dimensions, the strength and rigidity of the resulting bar could also be varied.

It is also possible to practice the present invention with bars which have cross-sectional shapes other than triangles. For example, circular, rectangular or any other multi-sided figure. In practicing the invention with other than a triangular-shaped cross-section, the longitudinally extending rods would still be disposed in parallel arrangement. Webs would be disposed between adjacent ones of the rods whereby to form a continuous configuration in cross-section.

In a wire structure suspension bar having a circular cross-section, a helix would be formed to extend in the longitudinal direction of the suspension bar. At least three longitudinally extending rods would be attached to the helix at the outer surface thereof. If three such rods are used, then the rods would be spaced at 120° from each other. The longitudinally extending rods would, as above-mentioned, be disposed in parallel arrangement. The web would comprise the strands of the helix.

As will be appreciated, instead of having a circular cross-section, it is possible to use the same helical principle in forming, for example, an oval cross-section.

Although a particular embodiment has been described, this was for the purpose of illustrating, but not limiting, the invention. Various modifications, which will come readily to the mind of one skilled in the art, are within the scope of the invention as defined in the appended claims.

We claim:

1. A truss-like wire structure suspension bar for garment boxes, said garment boxes having opposed bar engagement walls, said bar comprising:

a first top longitudinally extending wire rod;

a second top longitudinally extending wire rod disposed in parallel relationship with said first longitudinally extending wire rod said first and second rods defining a plane;

a bottom longitudinally extending wire rod disposed below and between said first and second top longitudinally extending wire rods, and in parallel relationship with the plane defined by said first and second top longitudinally extending wire rods;

a first web formed between said first top longitudinally extending wire rod and said bottom longitudinally extending wire rod whereby to define a first side member;

a second web formed between said second top longitudinally extending wire rod and said bottom longitudinally extending wire rod whereby to define a second side member;

a top web formed between said first top longitudinally extending wire rod and said second top longitudinally extending wire rod whereby to define a top member;

a cross sectional view of said first side member, said second side member and said top member defining a triangular shape;

said first side member, said second side member and said top member forming, between them, said truss-like wire structure;

means at each end of said truss-like wire structure for engaging a respective one of said opposed bar engagement walls; said engagement means comprising; a hook member; a first portion for attaching said hook member to said first longitudinally extending wire rod; a second portion for attaching said hook member to said second longitudinally exending wire rod; and a third portion for attaching said hook member to said bottom longitudinally extending wire rod.

2. A suspension bar as defined in claim 1 wherein said first and second webs comprise repeating triangles formed of wire;

said first web being provided for spacing said first top longitudinally extending wire rod from said bottom longitudinally extending wire rod and for providing structural strength to said bar;

said second web being provided for spacing said second top longitudinally extending wire rod from said bottom longitudinally extending wire rod and for providing structural strength to said bar;

said first web being attached to said first top longitudinally extending wire rod and said bottom longitudinally extending wire rod by welding said web to said first top and said bottom longitudinally extending wire rods at each point of contact thereof;

said second web being attached to said second top longitudinally extending wire rod and said bottom longitudinally extending wire rod by welding said web to said second top and said bottom longitudinally extending wire rods at each point of contact thereof.

3. A bar as defined in claim 2 wherein said top web is in the shape of repeating saw teeth, said web being provided for spacing said first top longitudinally extending wire rod from said second top longitudinally extending wire rod and providing structural strength for said bar;

said web being attached to said first and second top longitudinally extending wire rods by welding said web to a respective one of said rods at each point of contact thereof.

4. A bar as defined in claim 1 wherein said engagement means comprises a hook portion;

means for attaching said hook portion to said first top longitudinally extending wire rod, said second top longitudinally extending wire rod and said bottom longitudinally extending wire rod;

said engagement means being formed separately from said truss-like wire structure and being attached to said truss-like wire structure by welding.

5. Engagement means for attachment to each end of a truss-like wire structure forming a suspension bar for garment boxes, said truss-like wire structure comprising a first top longitudinally extending wire rod, a second top longitudinally extending wire rod and a bottom longitudinally extending wire rod;

said engagement means comprising;

a hook member;

a first portion for attaching said hook member to said first longitudinally extending wire rod;

a second portion for attaching said hook member to said second longitudinally extending wire rod; and a third portion for attaching said hook member to said bottom longitudinally extending wire rod; wherein said hook member comprises a first side and a second side; said first side comprising a first outer front portion and a spaced first inner front portion, said first outer front portion being connected to said first inner front portion by a first connecting portion; said first portion for connecting said hook member to said first top longitudinally extending wire rod extending from said first inner front portion; said second side comprising a second outer front portion and a spaced inner second inner front portion, said second outer front portion being connected to said second inner front portion by a second connecting portion; said second portion for connecting said hook member to said second top longitudinally extending wire rod extending from said second inner front portion.

6. An engagement means as defined in claim 5 wherein said hook member comprises a first side and a second side;

said first side comprising a first outer front portion and a spaced first inner front portion, said first outer front portion being connected to said first inner front portion by a first connecting portion;

said first portion for connecting said hook member to said first top longitudinally extending wire rod extending from said first inner front portion;

said second side comprising a second outer front portion and a spaced inner front portion, said second outer front portion being connected to said second inner front portion by a second connecting portion;

said second portion for connecting said hook member to said second top longitudinally extending wire rod extending from said second inner front portion.

7. An engagement means as defined in claim 6 wherein said hook member further comprises a first rear section disposed behind said first and second inner front portions and connected to said first outer front portion;

and a second rear portion disposed behind said second outer and inner front portions and connected to said second outer front portion;

said third portion for attaching said hook member to said bottom longitudinally extending wire rod extending from said first and second rear portions.

* * * * *

UNITED STATES PATENT AND TRADEMARK OFFICE

CERTIFICATE OF CORRECTION

PATENT NO. : 4,676,382

DATED : June 30, 1987

INVENTOR(S) : Frank Klein et al

It is certified that error appears in the above-identified patent and that said Letters Patent are hereby corrected as shown below:

Claim 4, line 1, after "wherein", insert --;--.
Claim 4, lines 1-6, delete "said engagement means comprises a hook portion; means for attaching said hook portion to said first top longitudinally extending wire rod, said second top longitudinally extending wire rod and said bottom longitudinally extending wire rod;"

Claim 4, line 7, change "being" to --is--.
Claim 4, line 8, change "being" to --is--.
Cancel claim 6.
Claim 7, line 1, change "6" to --5--.

Signed and Sealed this

Nineteenth Day of April, 1988

*Attest:*

DONALD J. QUIGG

*Attesting Officer*

*Commissioner of Patents and Trademarks*